United States Patent [19]

Björling

[11] Patent Number: 4,487,628

[45] Date of Patent: Dec. 11, 1984

[54] SELECTIVE REDUCTION OF HEAVY METALS

[75] Inventor: Gotthard Björling, Djursholm, Sweden

[73] Assignee: SKF Steel Engineering Aktiebolag, Hofors, Sweden

[21] Appl. No.: 532,181

[22] Filed: Sep. 14, 1983

Related U.S. Application Data

[63] Continuation of Ser. No. 324,696, Nov. 25, 1981.

[30] Foreign Application Priority Data

Mar. 10, 1981 [SE] Sweden ..... 8101495

[51] Int. Cl.[3] ..... C22B 4/00

[52] U.S. Cl. ..... 75/10 R; 75/11

[58] Field of Search ..... 75/10 R, 11

[56] References Cited

U.S. PATENT DOCUMENTS

| | | | |
|---|---|---|---|
| 3,989,512 | 11/1976 | Sayce | 75/10 R |
| 4,061,492 | 12/1977 | Fey | 75/10 R |
| 4,072,504 | 2/1978 | Perdahl | 75/10 R |
| 4,310,350 | 1/1982 | Santen | 75/10 R |

*Primary Examiner*—Peter D. Rosenberg

*Attorney, Agent, or Firm*—Brumbaugh, Graves, Donohue & Raymond

[57] ABSTRACT

The present invention relates to selective reduction of heavy metals out of finely grained, substantially oxidic material by blowing the oxidic material into a furnace together with an amount of reducing agent required for obtaining desired selectivity while simultaneously heat energy is supplied by a gas heated in a plasma generator, the temperature being adjusted to such a level as to correspond to the oxygen potential at which the desired metals are transformed into a particular, isolatable phase as metal melt, metal vapor, speiss or matte and at which the remaining metals enter into a slag phase and can be isolated as slag melt.

9 Claims, No Drawings

SELECTIVE REDUCTION OF HEAVY METALS

This application is a continuation of U.S. application Ser. No. 324,696, filed Nov. 25, 1981.

DESCRIPTION

The present invention relates to a method of selectively reducing heavy metals out of a fine-grain, substantially oxidic material.

It is known to reduce ferrous, finely grained oxidic material in a furnace by heating the material with a reducing gas transformed into plasma state, crude iron being drained from the bottom of the furnace and slag being drained from an overlying level. Coke is supplied through the top of the furnace and discharged exhaust gases are used for drying and preliminarily reducing the introduced oxidic material. The finely grained material containing iron oxide is blown into the plasma and into the coke hearth where reduction is performed with the aid of added reducing agent, coal and coke. Subsequently the metal and slag melt down below the plasma and form a layer and a superimposed fluid slag layer, these layers being separately discharged. When iron is reduced the reduction zone has a temperature of 1700°-2000° C.

The normal method of manufacturing copper from sulphide ore containing copper and iron, such as a copper pyrite, which is the most important copper ore, consists in preliminarily melting down the crude ore, possibly after a preceding partial roasting, such as to obtain, on the one hand, a sulphide melt called matte containing all the copper and some iron and, on the other hand, a silicate melt, designated as slag, containing gangue and in addition some of the iron of the copper ore. Matte is subsequently separated from the slag and by careful oxidation with atmospheric oxygen in a so-called converter, all the iron is transferred into a new slag and its sulphur into sulphur dioxide so that metallic copper, designated blister copper, is obtained. This is refined by melting to remove practically all metallic impurities except precious metals which can be removed only by electrolytic refining.

This known process has certain drawbacks. Such a drawback is the removal of sulphur which is performed in steps and in a process which has an irregular time scale and which on the one hand involves environmental problems and on the other hand renders the use of sulphur dioxides for the manufacture of sulphuric acid more difficult. Another drawback appears when work is performed, as is usual in modern copper mills, with a relatively high copper content in the matte because such a high copper content is obtained in the slag that this has to be subjected to a particular treatment. Finally, it may be mentioned that many copper raw materials often have a considerable content of zinc which normally is lost in the slag.

The above statements regarding sulphidic copper raw materials also apply to sulphidic bulk concentrates. Iron pyrite is often found in mineral source together with other metal sulphides in particular zinc blende, copper pyrite and galena. In many cases the material may be crushed and ground so that the various minerals form separate particles and thus may be separated technically by flotation but in many cases the base metal minerals are of so finely grained structure that it is not possible to obtain the various metal fractions with satisfactory yields; however, it is possible to separate the main portion of the iron pyrites and to collect the base metals in a so-called bulk concentrate. Such concentrates usually have a composition of the order of 1-4% Cu, 2-6% Pb, 15-25% Zn and in addition important contents of precious metals. There are today no metallurgical mills treating such concentrates and they have to be used together with the normal feed for copper, lead or zinc mills in an attempt to recover the total metal content from slags, drosses and other by-products. Thus, zinc concentrate may be recovered by slag-fuming from slags coming from copper and lead mills, copper is recovered from dross in lead refining and lead can be manufactured from the leaching residues in zinc mills.

However, all these methods only yield concentrates of metals other than the main metal and the recovery of metal therefrom costs approximately as much as the recovery from ore concentrate.

Slag-fuming is a rather ordinary process for recovery of the zinc and lead contents from slags emanating from copper and lead mills. Pulverized coal and a deficit of air is blown into the molten slag causing zinc and lead to be reduced-out and to form metal vapor which is burned and forms a fine dust of oxides in the exhaust gas. After purification a mixture of zinc oxide and lead oxide is obtained; in addition there are a number of other impurities such as oxides of tin and bismuth as well as fluorides and chlorides and sulphur in the form of sulphate.

The ordinary method to recover the metal content is based on so-called clinkering in which the mixed oxide is subject to a slight reduction at about 1250° C. where lead and most impurities are reduced and vaporized from the mixed oxide in a rotatory furnace. The yield is a weighted but approximately pure zinc oxide, limed clinker and a so-called lead dust which substantially comprises lead sulphate as well as impurities. Clinker has to be treated in a zinc mill, normally by leaching and electrolysis, whereas the lead dust is combined with the normal charge of a lead mill.

Ferro-nickel is an alloy comprising 20-36% Ni, the remainder being iron; it is used as nickel carrier for the manufacture of stainless steel and other special steels. Ferro-nickel is manufactured substantially in the same way as electric pig iron by reducing sintered and possibly preliminarily reduced ore with the aid of coke in an electrode furnace.

As the ore normally contains more iron in relation to the nickel content than is desirable in the final ferro-nickel, it is often necessary to produce by converter-blowing a slag corrosion of a certain part of the iron obtained by the reduction.

For the manufacture of ferro chromium containing 65-70% Cr, a chromite ore is required having a high Cr:Fe-ratio, desirably about 3. Such chromium ore is rather rare and is considerably more expensive than low-ratio ore having a ratio of about 1.8. Accordingly it is desirable to concentrate low-ratio ore in a simple way. Certain methods have been proposed which ordinarily are based on the manufacture of sponge iron from the chromite and removal of the metallic iron therefrom, such methods, however, being rather complicated and environmentally noxious.

Sometimes vanadium is found together with magnetite but in many cases in such low proportions, about 1%, that the recovery of vanadium by pelletizing of the magnetite with soda and recovery of the vanadate formed by leaching will be expensive. Moreover the quality of the pellet after leaching will be so low that the material can scarcely be sold as pellets.

The present invention provides a method of selectively reducing heavy metals out of finely grained, substantially oxidic material, in which process the oxidic material is blown into a furnace together with an amount of reducing agent required for obtaining a desired selectivity, while heat energy is simultaneously supplied by a gas heated in a plasma generator, the temperature being adjusted so as to correspond with the oxygen potential at which the desired metals are transformed into a particular, isolatable phase as metal melt, metal vapor, speiss or matte and at which the remaining metals enter into a slag phase and may be isolated as slag melt.

According to a preferred embodiment of the invention, the reduction is performed in a shaft filled with coke. The coke present takes part in the reduction only to a limited extent.

According to another preferred embodiment of the invention volatile metals forming part of the oxidic material are removed from the furnace as metal vapor which is condensed and recovered as metal melt.

Suitably the material stream blown into the furnace is so directed that it is caused to come substantially into contact with melt formed in the lower part of the furnace.

According to another preferred embodiment of the invention the amount of iron forming part of the oxidic material is scorified and retained as oxide during the reduction of the remaining material.

According to another preferred embodiment of the invention the oxidic material is preliminarily roasted whereby any sulphur present is eliminated.

According to another preferred embodiment of the invention a substantially sulphur-free oxidic material is introduced in the form of dust, reduction agent being supplied in an amount corresponding to 75–90% of the stoichiometric amount needed for reduction.

According to another preferred embodiment of the invention the temperature during reduction is at most 1350° C.

The above described disadvantages in the recovery of copper from sulphidic raw materials can be avoided by applying the present invention. Firstly, all sulphur may be removed by so-called dead-roasting; this is performed continuously and yields a high and even concentration of sulphur dioxide in the exhaust gases which facilitates is use and reduces environmental problems. The roasted material obtained is then blown together with a certain amount of coal powder and slag-former into a plasma heating furnace. The amount of coal powder and other conditions of the melting process are so adapted that all the copper but only a small part of the iron content is reduced-out in the furnace into a metal melt called black copper because, upon solidification, it assumes a black color due to the iron oxide present in the outer surface. The main amount of iron as well as all the gangue form a slag which has a very low copper content because it is in equilibrium with metallic iron in the black copper. The zinc content of the raw material is removed by reduction and forms zinc vapor which rises upwardly together with the exhaust gases through the furnace shaft and is condensed to form liquid metallic zinc when the exhaust gases are cooled.

In this way it has thus been possible to avoid the drawbacks inherent in the ordinary copper manufacture on the basis of sulphidic raw materials.

It is an obvious disadvantage that electric energy must be supplied for the reduction-melting but, as appears from the Examples which follow, this amount of energy is of the same order of magnitude as that required for melting copper slick in the electric furnace.

Also bulk concentrate may be treated in accordance with the present invention, the bulk concentrate initially being roasted for removal of almost all sulphur; only the amount required for the formation of the matte is retained. Subsequently other volatile compounds such as arsenic are removed by roasting. The roasted material is now melted in the same way as indicated for the roasted material obtained from copper concentrate. As zinc is the most plentiful of the base metals, the plasma-heated shaft furnace is preferably connected to a zinc condensor where reduced zinc is recovered. Copper and some parts of the iron form the matte but the lead particle form a particular metal melt which is separate from the matte. The reduction is performed selectively so that the main portion of the iron content as well as the gangue components are collected in the slag. Among the precious metals, gold principally enters the copper matte whereas silver predominantly is collected in the lead.

Thus, in one process step valuable metal products have been produced from the roasted bulk concentrate, namely copper matte from which metallic copper is easily manufactured, crude lead ready for refining as well as zinc products which are practically ready for sale. From copper and lead precious metals are recovered according to known methods.

The present invention provides a simplified method for treating a mixed oxide. In this case, however, impurities such as chlorides and fluorides should firstly be removed which is most easily performed by so-called light-clinker formation, the mixed oxides being treated in a rotatory furnace at about 1150° C. and at a very weak reduction, causing the halogens and sulphur to be removed whereas lead and other metals remain in the light-clinker.

The light-clinker is advantageously reduced in a plasmaheated shaft furnace. In the condensor flow, zinc is obtained directly whereas at the lower end lead is collected, said lead solving tin, bismuth and other metals of lower volatility than zinc.

It is advantageous to treat in the same process other intermediate products containing zinc and lead, such iron as forms part thereof being left unreduced in the final slag. Examples of such materials include converter dust from the conversion of matte, lead dust from lead shaft furnaces as well as slags containing zinc and lead. It is also more efficient to use such slags as now are subjected to slag-fuming directly for the recovery of zinc and lead in the form of metals in a plasma-heated shaft furnace.

By applying the present invention in the manufacture of ferro-nickel it is possible, by selective reduction, to produce the desired alloy directly. In this case the ore is preliminarily reduced in one or two steps using the CO and $H_2$ content of the furnace gas, and the preliminarily reduced material and slag formers are blown together with a determined amount of coal powder into a plasma-heated shaft furnace for reduction-removal of all nickel and an amount of iron as desired to obtain the quality of the ferro-nickel required, whereas the rest of the iron as well as the gangue components are caused to enter into the slag. In addition to being able to establish a suitable nickel content in the ferro-nickel, there are the following additional advantages: (A) the ore does not require to be sintered and (B) the reduction may be performed with coal not coke.

By the process of the present invention it is possible to perform a selective reduction of a suitable part of the iron out of a low-ratio ore by treatment in a plasma-heated shaft furnace. The chromite ore which suitably is finely grained, is suitably preliminarily reduced as stated above with the aid of the exhaust gases rich in CO and $H_2$, and the preliminarily reduced material with the addition of lime and possibly other slag formers is blown together with a weighted amount of coal powder into a plasma-heated melting furnace where a predetermined part of iron content of the chromite is reduced-out and forms a usable crude iron, whereas all the chromium and the remaining iron contents as well as added lime forms a slag melt composed of $FeO.Cr_2O_3$ and $CaO.Fe_2O_3$. This liquid slag may be transferred directly into a normal electric furnace for the manufacture of ferro-chromium. In addition to concentration, the following advantages are obtained: (A) the excess iron of the low-ratio ore can be used as primary crude iron (B) no sintering or pelletizing of the raw material is required, and (C) coal may be used as the main reducing agent.

The process of the present invention which permits selective reduction in a plasma-heated furnace can be used for vanadium concentration and offers an attractive alternative for using the vanadium content. Fundamentally, the same method is used as in the concentration of chromium ore. Magnetite, which advantageously should be finely grained, is suitably preliminarily reduced in the same way as indicated above using the CO and $H_2$ content of the furnace gas. The preliminarily reduced material with an addition of slag former is blown together with a measured amount of coal powder into a plasma-heated shaft furnace in which the main portion of the iron content, but no vanadium, is reduced-out to form a usable crude iron. The rest of the iron together with all the vanadium forms a slag which is transferred into a suitable conventional furnace for complete reduction yielding a crude iron rich in vanadium. By a well-known method, this iron may be carefully oxidized to form a slag rich in vanadium which can be used for the manufacture of either ferro-vanadium or vanadic acid.

The remaining advantages obtained by this procedure are substantially the same as indicated in connection with the treatment of chromite.

The present invention will now be described in more detail with reference to the following Examples.

EXAMPLE 1

Reduction melting of roasted copper pyrites. Copper pyrite slick having the following analysis was treated Cu: 28% as $CuFeS_2$
Zn: 3% as Zns
Pb: 1% as Pbs
$FeS_2$: 2%
$SiO_2$: 6.2%
CaO: 5.4%

After dead-roasting a roasted material was obtained having the composition:

31.1% Cu
28.2% Fe
3.3% Zn
1.1% Pb
0.2% S
6.9% $SiO_2$
6.0% CaO

The roasted material was mixed with pure silica sand and coal powder having the analysis 75% C, 10% H and 15% ashes, 147 parts silica sand and 7.1 parts coal powder being added per 100 parts of the roasted material. This mixture was blown into a plasma-heated shaft furnace and a black copper was obtained having the analysis Cu: 93.9%
Fe: 2.7%
Pb: 2.7%
S: 0.7%

In addition a slag having the following composition was obtained:

Fe: 44.3%
Zn: 0.9%
Pb: 0.3%
Cu: 0.2%
$SiO_2$: 33.0%
CaO: 9.3%

The copper yield in the black copper was 99.5%. 236 kg coal and 49 coke were used per ton copper.

At 80% efficiency in the plasma burner the consumption of electric energy amounted to 958 kWh/ton copper while simultaneously 97 kg zinc were recovered. Counted per ton copper slick, 66 kg coal and 14 kg coke were used as well as a total of 567 kWh electric energy.

The material was blown at an angle between 30° and 70°, preferably 55° in relation to the bath surface. The matte temperature amounted to about 1200° C. and the slag temperature to about 1300° C.

EXAMPLE 2

Reduction melting of roasted bulk concentrate.

The concentrate had the following composition:

2% Cu
4% Pb
20% Zn
20% Fe
1 As
15% $SiO_2$
13% CaO+MgO

After roasting the roasted material had the following analysis:

2.2% Cu
4.5% Pb
22.4% Zn
22.4% Fe
1.1% S
16.8% $SiO_2$
14.6% CaO+MgO 9.4 parts silica sand and 5.1% coal powder were added per 100 parts roasted material, and this mixture was blown into a plasma-heated shaft furnace at an angle of 50° in relation to the bath surface. The following products were obtained:

| | | |
|---|---|---|
| Matte: | 33% | Cu (tapped at 1150° C.) |
| | 42% | Fe |
| | 8% | Pb |
| | 17% | S |
| Metallic lead: | 97% | Pb |
| | 2% | Cu |
| | 1% | S |
| Zinc: | 99.5% | Zn |
| Slag: | 32.1% | Fe |

-continued

| | |
|---|---|
| 42.9% | $SiO_2$ |
| 23.8% | CaO |
| 0.2% | Cu |
| 0.4% | Pb |
| 0.7% | Zn |

The copper yield of the matte amounted to 95%.

The lead yield in the metallic lead was 94%.

The zinc yield in the flow zinc was 97%.

45 kg coal and 9.5 kg coke were used per ton bulk concentrate. At an efficiency of 80% in the plasma-preheater the energy consumption amounts to 797 kWh/ton slick.

The yield per ton slick was 194 kg flow zinc, 19 kg copper in matte and 38 kg lead in crude lead.

EXAMPLE 3

Treatment of mixed oxide.

The mixed oxide had the following composition:

| | Before formation of light-clinker | After formation of light-clinker |
|---|---|---|
| ZnO | 58% | 68% |
| PbO | 23% | 27% |
| $SnO_2$ | 2% | 2.5% |
| $Bi_2O_3$ | 2% | 2.5% |
| $SO^{2-}$ | 13% | |
| $Cl^{4-}$ and $F^{31}$ | | |
| | 100% | 100% |

The reduction of the light-clinker was performed after addition of 75.6 kg coal/ton mixed oxide. A lead alloy is obtained which was tapped at 850° C. and had the composition:

85.9% Pb as well as zinc containing more than 99% Zn 6.0% Sn 7.3% Bi 0.8% S

At an efficiency of 80% in the plasma burner the energy consumption was 978 kWh/ton mixed oxide.

EXAMPLE 4

Manufacture of ferro-nickel from laterite ore.

This Example was carried out using a laterite ore of the following analysis:

| | Ore | Preliminarily reduced material |
|---|---|---|
| Fe | 50.01% | 67.0% |
| Ni | 1.00% | 1.34% |
| Co | 0.06% | 0.08% |
| Cr | 2.40% | 3.2% |
| Mn | 5.2% | 7.0% |
| $Al_2O_3$ | 5.2% | 7.0% |
| CaO | 2.0% | 2.7% |
| MgO | 1.0% | 1.34% |
| $SiO_2$ | 4.9% | 6.6% |

The preliminarily reduced material was mixed with 22 parts silica and 8 parts coal powder per 100 parts of the material and was melted in a plasma-heated shaft furnace. Metal and slag of the following compositions were recovered:

| | Ferro-nickel (tapped at 1550° C.) | | Slag (tapped at 1600° C.) |
|---|---|---|---|
| Ni | 20% | Fe | 49.3% |
| Fe | 79% | $SiO_2$ | 22.5% |
| Co | 1% | Cr | 2.6% |

The warm slag may without great expense be further reduced to yield crude iron.

A total of 522 kWh was used per ton laterite for the manufacture of 50 kg ferro-nickel which means that 52,200 kWh are required per ton nickel.

EXAMPLE 5

Upgrading of low-ratio chromium ore.

The raw material was a chromium ore having the analysis:

Fe: 23.6% the ratio thus being 1.8

Cr: 42.5%

$SiO_2$: 7.7%

The intention was to reduce out so much iron that the ratio in the residue, i.e. the slag, amounted to 3.0.

After graining, the ore was mixed with 23 parts burned lime and 16 parts coal powder per 100 parts ore. During melting in a plasma-heated shaft furnace, a crude iron and a slag were obtained. These had the following analyses:

| Crude iron 96.6 kg (tapped at 1575° C.) | | Slag 1102 kg (tapped at 1650° C.) | |
|---|---|---|---|
| Fe | 98.3% | Fe | 12.8% |
| Cr | 1.1% | Cr | 38.5% |
| C | 0.6% | CaO | 20.6% |
| | | $SiO_2$ | 6.8% |

The consumption of electric energy amounted to a total of 800 kWh/ton chromite ore.

EXAMPLE 6

Concentration of the V-content in magnetite.

The treatment was performed on a vanadium-containing magnetite concentrate having the analysis:

| | |
|---|---|
| 94.7% | Fe |
| 1.0% | V |
| 4.3% | $SiO_2$ |
| 100% | |

After preliminary reduction to the FeO stage the concentrate was reduction melted in a plasma-heated shaft furnace with the addition of 10 parts coal powder per 100 parts preliminarily reduced material. No addition of slag former was required.

A crude iron and slag were received:

| Crude iron (tapped at 1450° C.) | | Slag (tapped at 1500° C.) | |
|---|---|---|---|
| 98.2% | Fe | 65.9% | FeO |
| 0.08% | V | 10.2% | $V_2O_5$ |
| 1.7% | C | 23.9% | $SiO_2$ |

The vanadium yield in the slag was 95%. After reduction melting of the slag it is possible to obtain a vanadium-crude iron containing about 10% V from which by careful oxygenation a saleable vanadium slag can be obtained. It is also possible to leach out the vanadium from the first slag after sintering with soda.

At an efficiency of 80% in the plasma burner 93 kg coal and 799 kWh were used in the melting per ton magnetite slick.

It is generally valid for all the embodiments that the angle at which the material is blown towards the bath surface amounts to between 30° and 70°, preferably about 50°. As regards the amount of energy, 5 kWh/$m^3$ (n) plasma gas have generally been used.

I claim:

1. A method of selectively reducing heavy metals out of finely grained, substantially oxidic material, comprising the steps of blowing oxidic material containing the oxides of at least two metals selected from the group consisting of Fe, Cu, Zn, Pb, Ni, Cr and V into a shaft filled with coke together with an amount of reducing agent required for obtaining a desired selectivity, simultaneously supplying heat energy by a gas heated in a plasma generator, adjusting the effective oxygen potential to that at which the desired metal oxides are tranformed into a particular, isolatable phase as metal melt, metal vapor, speiss or matte and at which the remaining metal oxide enters into a slag phase and may be isolated as slag melt by regulating the ratio between the amount of said reducing agent and said oxidic material and further by regulating the amount of heat energy supplied, and thereby selectively reducing at least one metal in such a manner that said coke does not substantially participate in the reduction reaction, and simultaneously not substantially reducing at least one of said oxides said at least one of said oxides not reduced including substantially all of the oxides of chromium and vanadium oxide, if any, present in the oxidic material.

2. A method according to claim 1 including the step of directing the blown-in oxidic material and reducing agent such that it is brought substantially into contact with a melt formed in the bottom of a shaft, whereby the coke in the shaft does not substantially participate in the reduction reaction.

3. A method according to claim 1 including the steps of removing reduced volatile metals from the shaft as metal vapor and condensing and recovering the metal vapor as metal melt.

4. A method according to claim 3 wherein the volatile metal includes zinc.

5. A method according to claim 1 wherein the oxidic material contains iron and at least one of the metals selected from the group consisting of Cu, Zn, Ni and Pb, and including the step of retaining the iron as oxide while reducing the remaining metal oxides to metal.

6. A method according to claim 1 wherein the oxidic material contains iron and including the steps of retaining the iron as oxide and adjusting the effective oxygen potential by adjusting the amount of heat energy supplied such that the mean temperature during reduction does not exceed about 1350° C.

7. A method according to claim 1 wherein the oxidic material contains Cu and an amount of S sufficient to form matte.

8. A method according to claim 1 wherein the oxidic material contains low ratio chromite ore and including the step of selectively reducing Fe by adjusting the effective oxygen potential by adjusting the amount of heat energy supplied such that the mean temperature during reduction does not exceed about 1650° C.

9. A method according to claim 1 wherein the oxidic material contains V-containing magnetite and including the step of selectively reducing Fe by adjusting the effective oxygen potential by adjusting the amount of heat energy supplied such that the mean temperature during reduction does not exceed about 1500° C.

* * * * *